US007943839B2

(12) United States Patent
Nagakura

(10) Patent No.: US 7,943,839 B2
(45) Date of Patent: May 17, 2011

(54) TUNING DEVICE

(75) Inventor: Fumiyoshi Nagakura, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 12/583,265

(22) Filed: Aug. 18, 2009

(65) Prior Publication Data

US 2010/0043624 A1 Feb. 25, 2010

(30) Foreign Application Priority Data

Aug. 20, 2008 (JP) ..... 2008-211712

(51) Int. Cl.
*G10D 1/08* (2006.01)

(52) U.S. Cl. ..... 84/312 R

(58) Field of Classification Search ..... 84/312 R, 84/453

See application file for complete search history.

(56) References Cited

U.S. PATENT DOCUMENTS 7,655,851 B2 * 2/2010 Nagakura ..... 84/312 R

* cited by examiner

*Primary Examiner* — Kimberly R Lockett
(74) *Attorney, Agent, or Firm* — Adams & Wilks

(57) ABSTRACT

Provided is a tuning device including: a tuning device main body including an electric circuit for computing a tuning state of a musical instrument; a clip portion including a pair of plate materials for attaching the tuning device main body to the musical instrument; a joint member for joining the tuning device main body and the clip portion; and a vibration sensor for sensing a sound emitted from the musical instrument, the joint member including: a first pivot portion for making the clip portion free to pivot about an extension direction of the joint member; and a second pivot portion for making the tuning device main body free to pivot about a direction perpendicular to the extension direction. The vibration sensor is incorporated into the joint member, and is structured to be rotatable about the extension direction unitarily along with the tuning device main body.

10 Claims, 11 Drawing Sheets

TUNING DEVICE

BACKGROUND OF THE INVENTION

1. Field of the Invention

The present invention relates to a tuning device.

2. Description of the Related Art

Up to now, there are known tuning devices configured to perform tuning by using pitch information of an arbitrary input sound as a reference. FIG. 11 illustrates a structure of a conventional tuning device 400. A microphone 401 and a vibration sensor 405 each sample a sound emitted from a musical instrument, and convert the sound into an electrical signal. An amplifier 402 receives an output signal from at least one of the microphone 401 and the vibration sensor 405, and amplifies the electrical signal to a desired level. A CPU 403 includes pitch extracting means for receiving an output signal from the amplifier 402 and extracting from the output signal a fundamental period of the sound sampled by at least one of the microphone 401 and the vibration sensor 405. In addition, the CPU 403 includes reference sound setting means, by which a user presets a reference sound. The CPU 403 further includes pitch error detecting means, by which an output from the pitch extracting means and an output from the reference sound setting means are received to calculate a pitch error therebetween and then output a result thereof to display means 404. The display means 404 visually displays a pitch difference between the reference sound and the sound emitted from the musical instrument to be tuned. It is called a "tuning function" of the tuning device to indicate an index during the tuning of the musical instrument with the above-mentioned structure.

Note that as the vibration sensor 405, a compact part such as a piezoelectric element is used. As the pitch extracting means, instructions such as "measure the period of a fundamental wave component having the longest period in the input signal" are stored in a memory of the CPU 403. In a similar manner, as the pitch error detecting means, instructions such as "calculate the frequency difference between the input signals" are stored in the memory of the CPU 403. The amplifier 402, the memory, and the like are mounted on a circuit board, which is contained inside a main body of the tuning device. The reference sound setting means is constituted by a switch and the like. The display means 404 is constituted by a meter, an LCD, a combination of a plurality of LEDs, and the like. FIG. 12 illustrates an external appearance of a general tuning device.

Before placing a conventional tuning device, it is necessary to search for a place in which the tuning device may efficiently sense the sound emitted from the musical instrument to be tuned. In tuning a brass instrument, a sound emitting side in the vicinity of a bell thereof is the most efficient position for sampling the sound. However, placing the tuning device in the above-mentioned position raises a problem in that the bell conceals a display surface from view. In order to solve such a problem, there is proposed a tuning device equipped with a pivotable joint between a clip portion for pinching the vicinity of a sound emitting portion of the musical instrument and the display surface for displaying a result of the tuning thereon, which may be located in a position that makes it easy for a player to visually recognize the display surface (see, for example, JP 2003-255932 A).

Incidentally, in the tuning device disclosed in JP 2003-255932 A, wirings are used to connect the vibration sensor attached to the clip portion and the circuit board disposed inside the display portion with each other, and when the display portion is caused to pivot, the wirings arranged inside the joint are caused to pivot together, which may result in the twisted wirings. This leads to a problem that the wirings are broken in a short period of time. Therefore, there is proposed a tuning device having the vibration sensor provided to the display portion side instead of the clip portion. However, such a structure makes it difficult for the vibration sensor to sense the sound, leading to a problem that performance as the tuning device may be lowered.

SUMMARY OF THE INVENTION

Therefore, the present invention has been made in view of the above-mentioned circumstances, and an object thereof is to provide a tuning device capable of improving durability thereof without impairing a tuning function.

In order to achieve the above-mentioned object, the present invention provides the following means.

A tuning device according to the present invention comprises: a tuning device main body including an electric circuit for computing a tuning state of a musical instrument; a clip portion including a pair of plate materials for attaching the tuning device main body to the musical instrument; a joint member for joining the tuning device main body and the clip portion; and a vibration sensor for sensing a sound emitted from the musical instrument, the joint member comprising: a first pivot portion for making the clip portion free to pivot about an extension direction of the joint member; and a second pivot portion for making the tuning device main body free to pivot about a direction perpendicular to the extension direction, wherein the vibration sensor is incorporated into the joint member, and is structured to be rotatable about the extension direction unitarily along with the tuning device main body.

According to the above-mentioned structure, the tuning device may be attached to the musical instrument with the pair of plate materials of the clip portion pinching the musical instrument, and may be located in a position that allows a player to visually recognize a display surface of the tuning device main body by causing the tuning device main body to pivot along with the joint member (first pivot portion and second pivot portion). Further, it is possible to locate the vibration sensor in close proximity of the clip portion by incorporating the vibration sensor into the joint member. This prevents the tuning function from being impaired.

Further, the vibration sensor is incorporated into the joint member, and hence the vibration sensor is rotated unitarily when the joint member is caused to pivot about the extension direction thereof to thereby rotate the tuning device main body, which may prevent the wirings connecting the vibration sensor and the electric circuit disposed inside the tuning device main body from being twisted. Accordingly, it is possible to prevent the wirings from being broken in a short period of time and to improve durability of the tuning device.

Further, there is provided a turning device wherein: the joint member is disposed to penetrate one of the plate materials of the clip portion; and the vibration sensor is located on an abutment surface side of the one of the plate materials in abutment with the musical instrument.

According to the above-mentioned structure, the vibration sensor may be located in an immediate area of the musical instrument, which makes it easier for the vibration sensor to sense the sound.

Further, there is provided a tuning device wherein the vibration sensor and the electric circuit disposed inside the tuning device main body are connected to each other by wirings that are suspended inside the joint member.

According to the above-mentioned structure, the wirings are not exposed, and hence it is possible to prevent the wirings from being broken due to an external factor such as contacting and to improve the durability of the tuning device. Further, the wirings may not be visually recognized, which may enhance an appearance thereof. Note that the tuning device main body may be pivoted in the second pivot portion only within a limited range, which prevents the wirings in the second pivot portion from being twisted.

Further, there is provided a tuning device wherein: the second pivot portion includes a pivot shaft formed of a conductive material; and the vibration sensor and the electric circuit disposed inside the tuning device main body are electrically connected to each other via the pivot shaft.

According to the above-mentioned structure, bending deformation of the wirings is not repeated in the second pivot portion, which may further improve the durability of the tuning device.

Further, there is provided a tuning device wherein: the joint member includes plating wirings on one of an inner surface thereof and an outer surface thereof; and the vibration sensor and the electric circuit are electrically connected to each other via the plating wirings.

According to the above-mentioned structure, the wirings may be removed from between the first pivot portion and the second pivot portion. In other words, the joint member may be made to function as a part of the wirings. Accordingly, the wirings are located only in a part in which the second pivot portion and the electric circuit disposed inside the tuning device main body are connected to each other, which makes it possible to reliably suppress the breaking of the wirings and to further improve the durability of the tuning device.

Further, there is provided a tuning device wherein: the joint member is formed of a conductive material; and the vibration sensor and the electric circuit are electrically connected to each other via the joint member.

According to the above-mentioned structure, at least one of the wirings may be removed from between the first pivot portion and the second pivot portion. In other words, the joint member may be made to function as apart of the wirings. Accordingly, the wirings are located only in a part in which the second pivot portion and the electric circuit disposed inside the tuning device main body are connected to each other, which makes it possible to reliably suppress the breaking of the wirings and to further improve the durability of the tuning device.

The tuning device according to one embodiment of the present invention may be attached to the musical instrument with the pair of plate materials of the clip portion pinching the musical instrument, and may be located in the position that allows the player to visually recognize the display surface of the tuning device main body by causing the tuning device main body to pivot along with the joint member (first pivot portion and second pivot portion). Further, it is possible to locate the vibration sensor in close proximity of the clip portion by incorporating the vibration sensor into the joint member. This prevents the tuning function from being impaired.

Further, the vibration sensor is incorporated into the joint member, and hence the vibration sensor is rotated unitarily when the joint member is caused to pivot about the extension direction thereof to thereby rotate the tuning device main body, which may prevent the wirings connecting the vibration sensor and the electric circuit disposed inside the tuning device main body from being twisted. Accordingly, it is possible to prevent the wirings from being broken in a short period of time and to improve durability of the tuning device.

DETAILED DESCRIPTION OF THE PREFERRED EMBODIMENTS

First Embodiment

Next, description is made of a tuning device according to a first embodiment of the present invention based on FIGS. 1 to 6.

Figure 1:
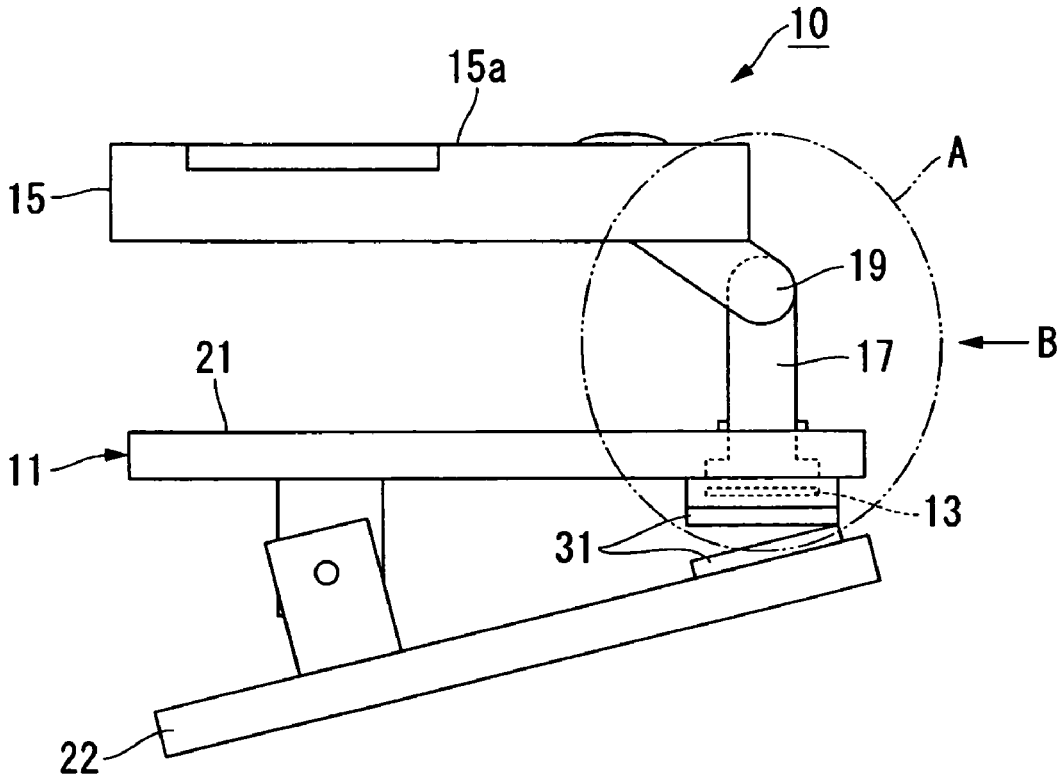
FIG. 1 is a side view of a tuning device according to a first embodiment of the present invention.

As illustrated in FIG. 1, a tuning device 10 includes: a clip portion 11 including a pair of plate materials 21 and 22 adapted to be engaged with each other; a vibration sensor 13 for detecting a vibration state of a sound emitted from a musical instrument; a display portion 15 that is mounted with an electronic circuit (not shown) for processing an electrical signal transmitted from the vibration sensor 13 and a battery (not shown) for driving the electronic circuit and is configured to be able to display a judgment result thereof; and a first pivot portion 17 and a second pivot portion 19 that join the clip portion 11 and the display portion 15 to each other.

The clip portion 11 may pinch the vicinity of a sound emitting portion of the musical instrument with the pair of plate materials 21 and 22 by a repulsive force of a spring material disposed therebetween. As the spring material, for example, a plate spring, a coil spring, or the like is used. The clip portion 11 may pinch a portion having a thickness equal to or smaller than a width of an opening formed between the pair of plate materials 21 and 22, such as a part of a bell or a pipe of a wind instrument or a neck of a guitar.

As the vibration sensor 13, for example, a piezoelectric element is used, and is preferable in that the piezoelectric element has a function of generating a reference sound for the tuning device 10. The piezoelectric element converts into an electrical signal a mechanical strain developed in the piezoelectric element due to a vibration. By utilizing the above-mentioned property, the vibration caused when the sound is generated from the musical instrument may be recognized by way of the electrical signal. Further, by utilizing another property that application of a voltage to the piezoelectric element develops a strain corresponding to varied values of the applied voltage in the piezoelectric element, a vibration in an audible range may be induced in the piezoelectric element to constitute a sound emitting body.

In this embodiment, the piezoelectric element externally having a substantially circular shape is used as the vibration sensor 13, and also serves a role as the sound emitting body for generating a reference sound at the same time. Such a structure allows one piezoelectric element to double as having a tuning function and a reference sound generating function, which may achieve space saving and reduction in the number of parts. As a result, the tuning device 10 may be structured to be small, lightweight, and inexpensive.

The display portion 15 includes a display screen for displaying a tuning state on a display surface 15*a*, and is mounted therein with an electric circuit and a battery. Used as the display screen is a meter, an array of a plurality of LEDs, an LCD display device, or the like. In this embodiment, the LCD constitutes the display screen. An electric signal from the vibration sensor 13 is amplified to be an electrical signal at a desired level by an amplification circuit. The amplified signal is then inputted to pitch extracting means. The pitch extracting means is implemented by a microcomputer and a memory which storing instructions such as "measure the period of a fundamental wave component having the longest period in the input signal". The pitch measured herein and a preset reference pitch are inputted to pitch error detecting means. The pitch error detecting means is implemented by the microcomputer and the memory storing instructions such as "calculate the frequency difference between the input signals". In accordance with a frequency deviation calculated herein, the LCD display device is caused to display a result thereof.

Figure 2:
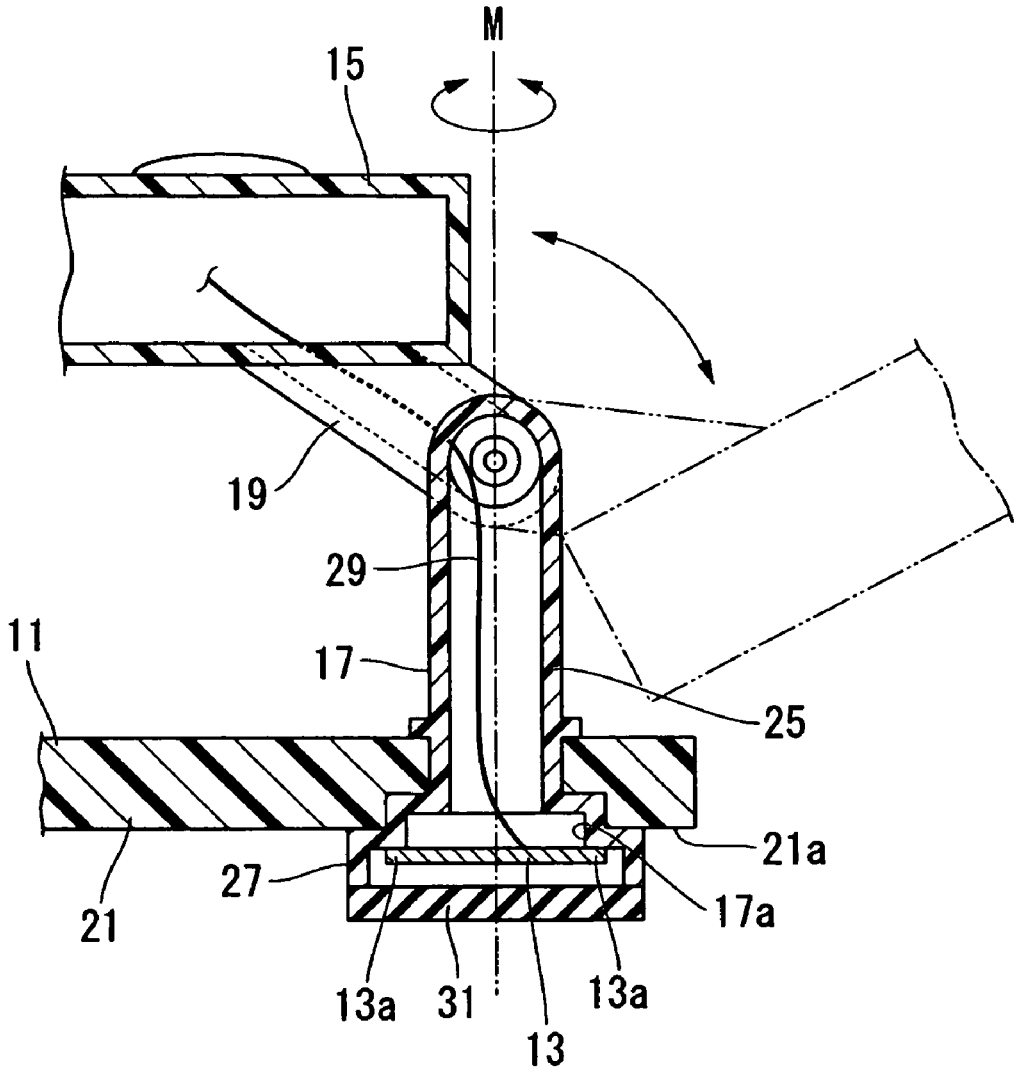
FIG. 2 is a detailed sectional view of a portion A of FIG. 1.

As illustrated in FIG. 2, the first pivot portion 17 is a member made of, for example, resin and having a substantially cylindrical shape. The first pivot portion 17 includes: a shaft portion 25 that is erected in a direction orthogonal to an abutment surface 21*a* of one of the plate materials (for example, plate material 21) of the clip portion 11 in abutment with the musical instrument and is structured to be rotatable about an axis M by 360 degrees; and a containing portion 27 formed in an end portion on a plate material 21 side of the shaft portion 25 so as to have a diameter larger than the shaft portion 25. Further, in this embodiment, the shaft portion 25 penetrates the plate material 21, and the containing portion 27 is disposed to the plate material 21 on an inner surface side thereof (opposed to the plate material 22). The shaft portion 25 and the containing portion 27 are both hollow inside, and the containing portion 27 contains the vibration sensor 13 in an inside thereof. The vibration sensor 13 has a peripheral portion 13*a* adhered/fixed to an inner surface 17*a* of the first pivot portion by an adhesive or the like.

The above-mentioned structure causes the vibration sensor 13 to develop a strain against the sound emitted from the musical instrument. Further, wirings 29 connecting the vibration sensor and the electric circuit disposed inside the display portion are arranged along the inside of the first pivot portion 17. In addition, a pad 31 is provided to an end surface of the containing portion 27. With this structure, when the first pivot portion 17 is rotated about the axis M, the display portion 15 is caused to rotate, and the vibration sensor 13 and the pad 31 are caused to rotate unitarily.

Figure 3:
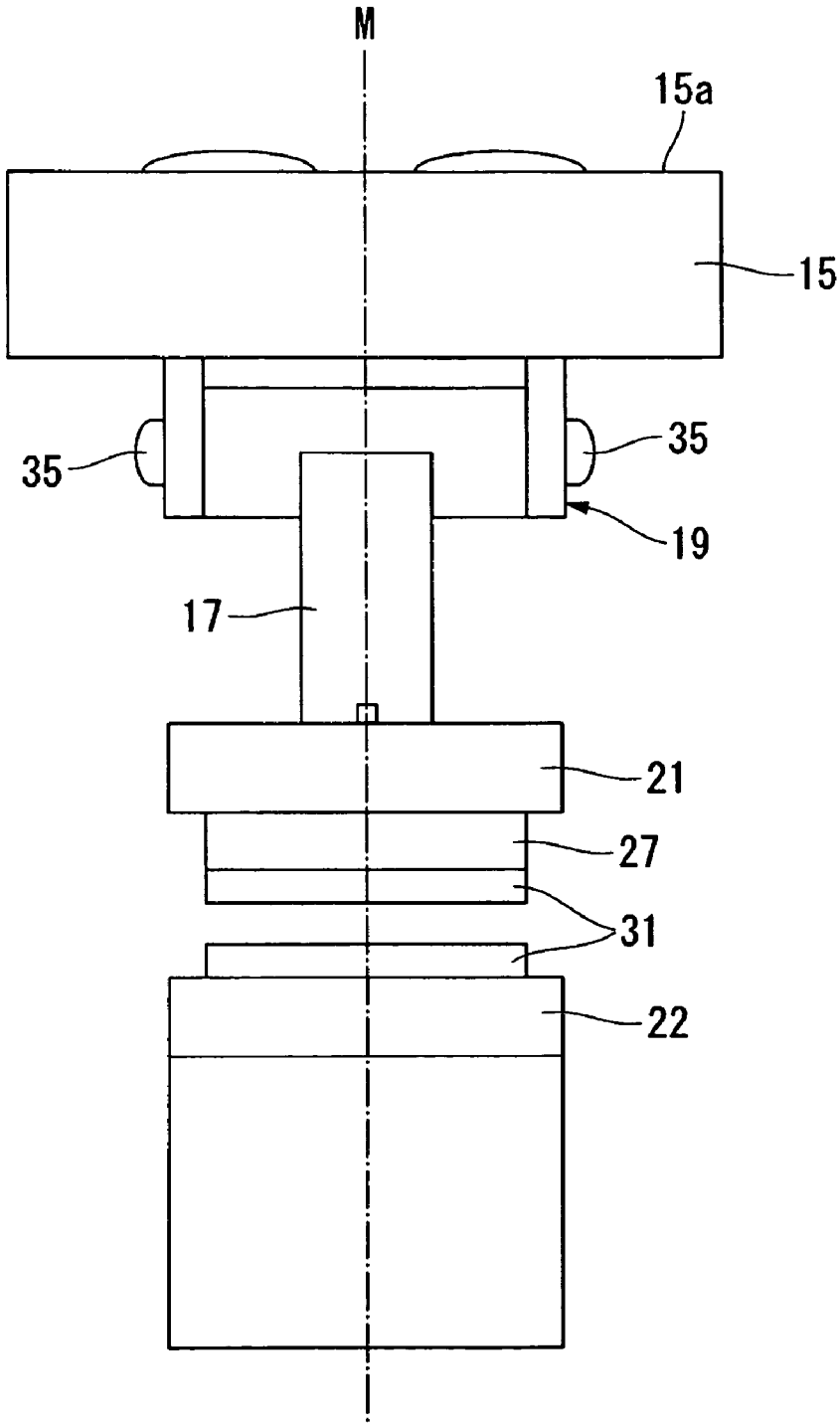
FIG. 3 is a view from a direction of an arrow B of FIG. 1.

As illustrated in FIG. 3, the second pivot portion 19 is formed in a portion in which the first pivot portion 17 and the display portion 15 are joined to each other, and includes a pivot shaft 35 formed in a direction within a face perpendicular to the axis M. The second pivot portion 19 is configured such that the display portion 15 may be pivoted by substantially 180 degrees across the first pivot portion 17 by pivoting the display portion 15 about the pivot shaft 35. The second pivot portion 19 is hollow inside, the wirings 29 that connect the vibration sensor 13 and the electric circuit disposed inside the display portion 15 are arranged along the inside of the second pivot portion 19.

(Operation)

Next, description is made of an operation of the tuning device 10.

Figure 4:
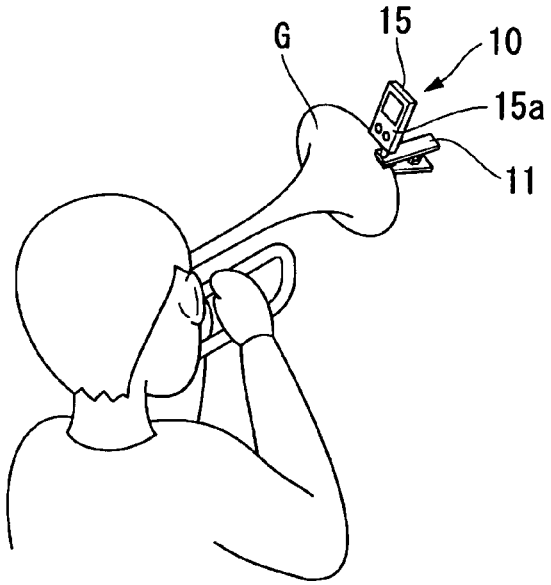
FIG. 4 is a diagram for explaining a case where the tuning device according to the first embodiment of the present invention is attached to a musical instrument.

As illustrated in FIG. 4, to tune a musical instrument G, the tuning device 10 is first attached to the musical instrument G in such a manner that an appropriate portion of the musical instrument G in the vicinity of the sound emitting portion is pinched between the pair of plate materials 21 and 22 of the clip portion 11.

Subsequently, the first pivot portion 17 and the second pivot portion 19 are caused to pivot so as to allow a player to visually recognize the display surface 15*a* of the display portion 15.

After a position that allows the display surface 15*a* of the display portion 15 to be visually recognized is set, a switch (not shown) provided to the display portion 15 is turned on, and then tuning is performed while emitting a sound from the musical instrument G.

Note that the tuning device 10 of this embodiment uses the piezoelectric element as the vibration sensor 13, and has the reference sound generating function. In a case of using the reference sound generating function, it is possible to generate the reference sound from the piezoelectric element by switching the function to the reference sound generating function by using the switch provided to the display portion 15.

According to this embodiment, it is possible to locate the display portion 15 in the position that allows the player to visually recognize the display surface 15*a* thereof by placing the tuning device 10 with the clip portion 11 pinching the musical instrument G and by causing the display portion 15 to pivot along with the first pivot portion 17 and the second pivot portion 19. In addition, it is possible to locate the vibration sensor 13 in close proximity of the clip portion 11 by incorporating the vibration sensor 13 into the first pivot portion 17. This prevents the tuning function from being impaired.

Further, the vibration sensor 13 is incorporated into the first pivot portion 17, and hence the vibration sensor 13 is rotated unitarily when the first pivot portion 17 is caused to pivot to thereby rotate the display portion 15, which may prevent the wirings 29 connecting the vibration sensor 13 and the electric circuit disposed inside the display portion 15 from being twisted. Accordingly, it is possible to prevent the wirings 29 from being broken in a short period of time and to improve durability thereof.

Further, the first pivot portion 17 is located so as to penetrate the plate material 21 of the clip portion 11, and the vibration sensor 13 is located on a side of the abutment surface 21*a* of the plate material 21 in abutment with the musical instrument G, and hence the vibration sensor 13 may be located in an immediate area of the musical instrument G, which makes it easier for the vibration sensor 13 to sense the sound.

Further, the wirings 29 connecting the vibration sensor 13 and the electric circuit disposed inside the display portion 15 are contained inside the first pivot portion 17 and the second pivot portion 19, and hence it is possible to prevent the wirings 29 from being broken due to an external factor such as contacting and to improve the durability of the tuning device 10. Further, the wirings 29 may not be visually recognized, which may enhance an appearance thereof.

Figure 5:
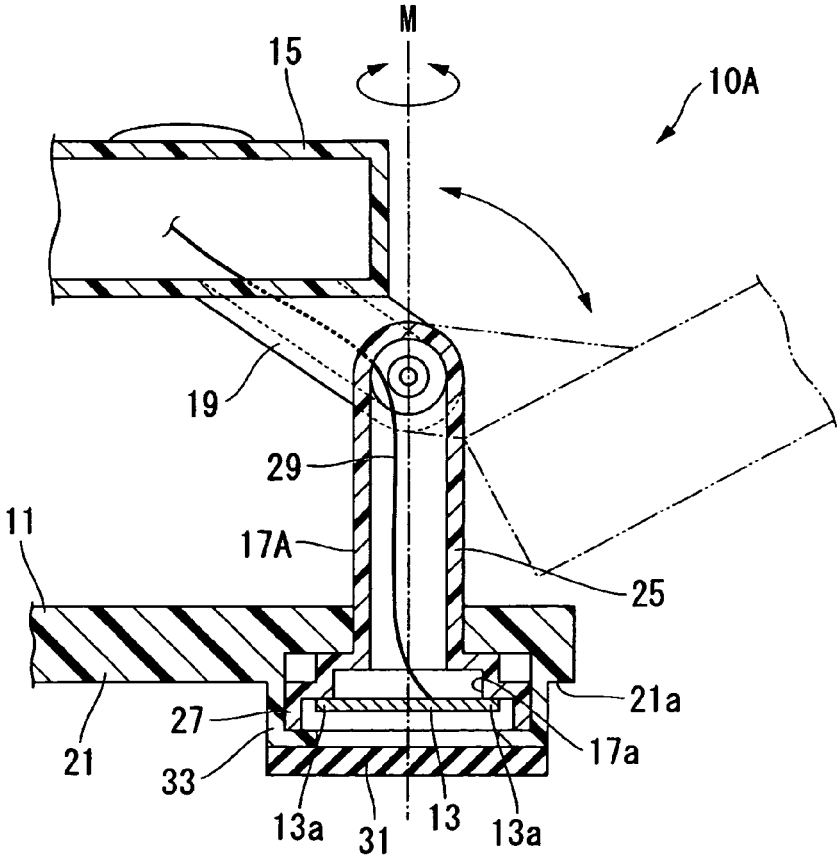
FIG. 5 is a sectional view illustrating a modified example of a first pivot portion according to the first embodiment of the present invention.
Figure 6:
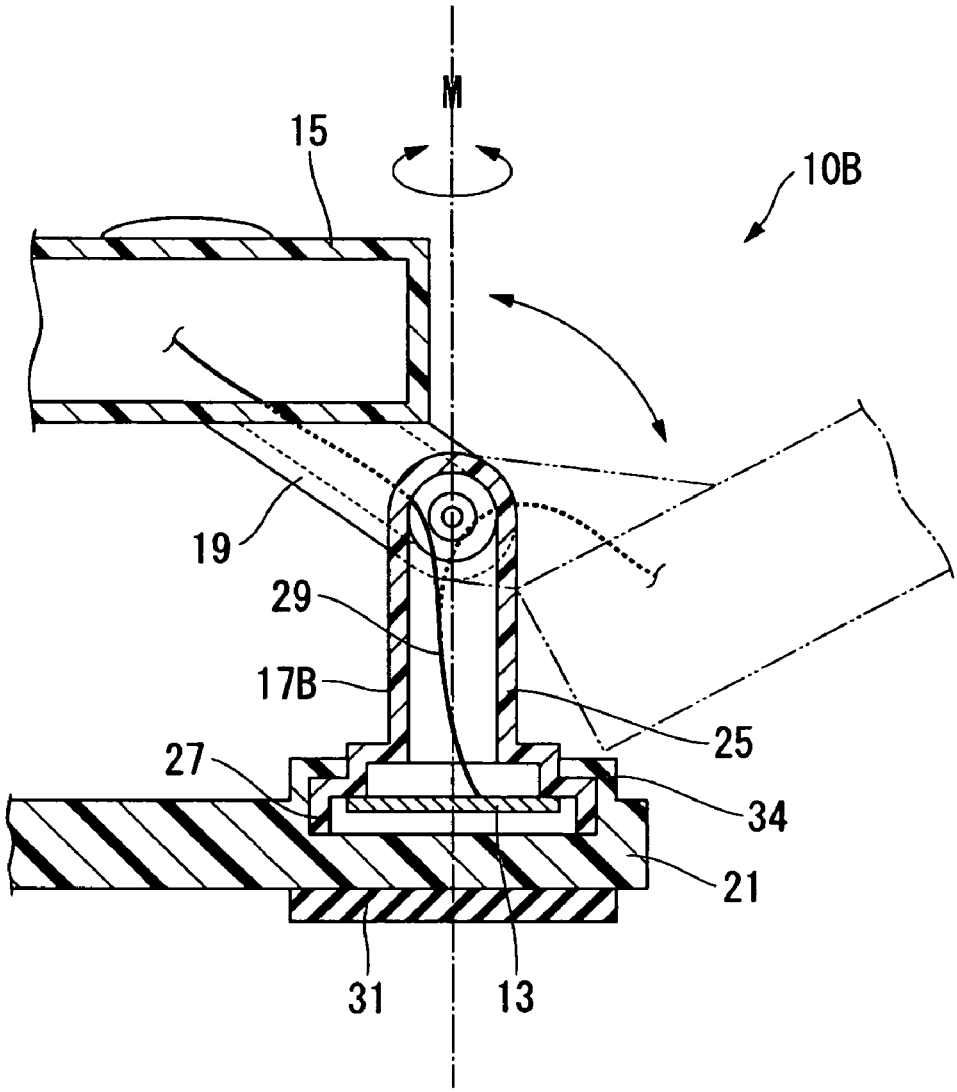
FIG. 6 is a sectional view illustrating another modified example of the first pivot portion according to the first embodiment of the present invention.

Note that tuning devices as illustrated in FIGS. 5 and 6 may be employed as modified examples of this embodiment.

In a tuning device 10A as illustrated in FIG. 5, the shaft portion 25 of a first pivot portion 17A penetrates the plate material 21, and the containing portion 27 is disposed to the plate material 21 on the inner surface side thereof (opposed to the plate material 22). In addition, a bulging portion 33 in which the containing portion 27 may be located is formed to the inner surface of the plate material 21. The pad 31 is provided to an end surface of the bulging portion 33. With this structure, when the first pivot portion 17A is rotated about the axis M, the vibration sensor 13 is caused to rotate unitarily.

In a tuning device 10B as illustrated in FIG. 6, the shaft portion 25 of a first pivot portion 17B does not penetrate the plate material 21, and the containing portion 27 is disposed to the plate material 21 on an outer surface side thereof (on a side on which the display portion 15 is located). The containing portion 27 is located inside a concave containing portion 34 formed to an outer surface side of the plate material 21. In addition, the pad 31 is provided to the inner surface side of the plate material 21. With this structure, when the first pivot portion 17B is rotated about the axis M, the vibration sensor 13 is caused to rotate unitarily.

Also in the tuning devices 10A and 10B, in a similar manner to the above-mentioned embodiment, the wirings 29 are not twisted even when the display portion 15 is caused to pivot, which may improve the durability.

Second Embodiment

Next, description is made of a tuning device according to a second embodiment of the present invention based on FIGS. 7 to 10. Note that this embodiment is different from the first embodiment only in the structures of the first pivot portion and the second pivot portion, while the other components and portions are substantially the same as those of the first embodiment, and hence the same components and portions are denoted by the same reference symbols to thereby omit detailed description thereof.

Figure 7:
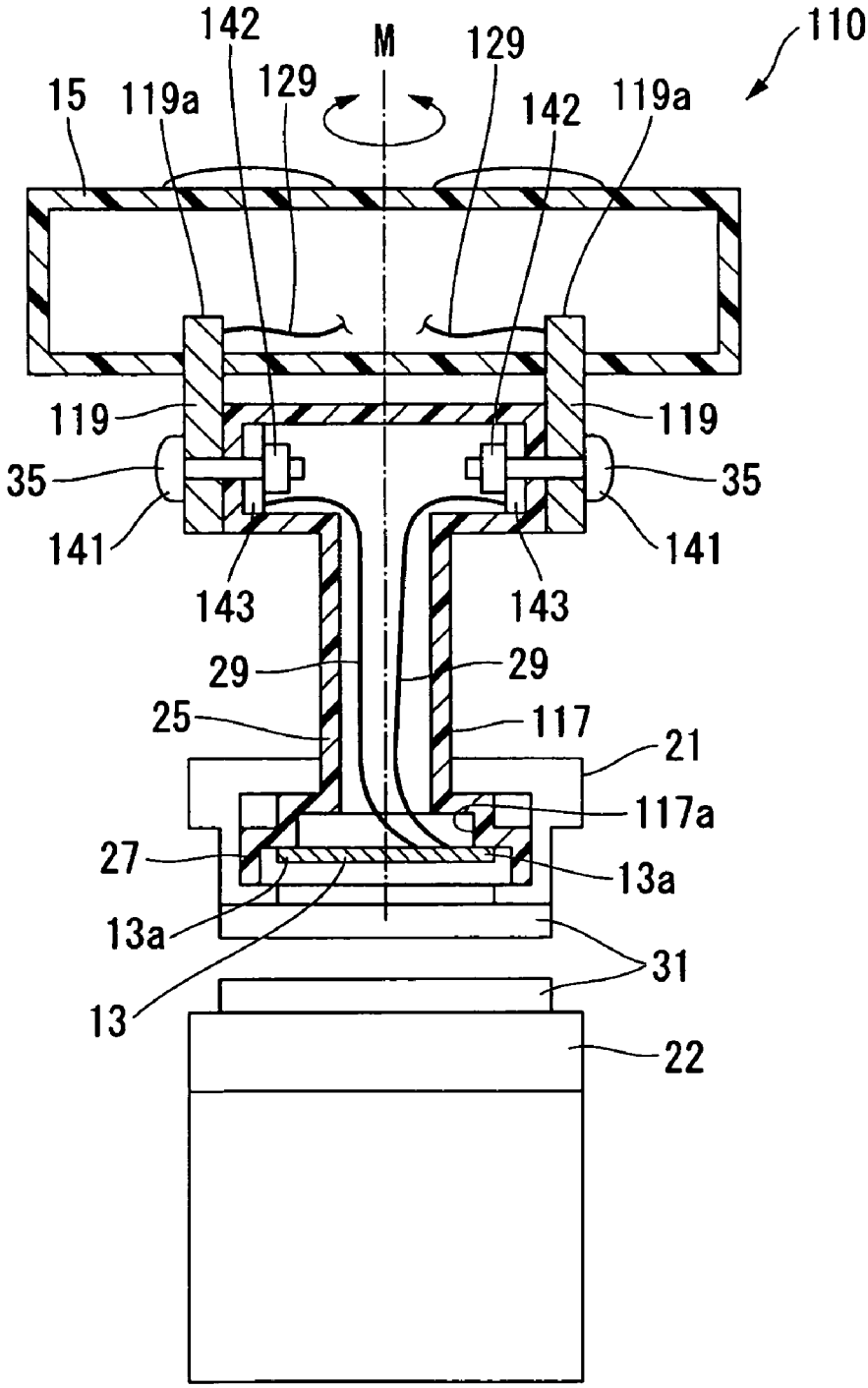
FIG. 7 is a sectional view (from the direction of the arrow B of FIG. 1) illustrating the first pivot portion and a second pivot portion according to a second embodiment of the present invention.

As illustrated in FIG. 7, a first pivot portion 117 of a tuning device 110 is a member made of, for example, resin and having a substantially cylindrical shape. The first pivot portion 117 includes: the shaft portion 25 structured to be rotatable about the axis M by 360 degrees; and the containing portion 27 formed in the end portion on the plate material 21 side of the shaft portion 25 so as to have a larger diameter. The containing portion 27 contains the vibration sensor 13 in the inside thereof. The vibration sensor 13 has the peripheral portion 13*a* adhered/fixed to an inner surface 117*a* of the first pivot portion 117 by an adhesive or the like. Further, the wirings 29 connecting the vibration sensor 13 and the electric circuit disposed inside the display portion 15 are arranged along the inside of the first pivot portion 117.

A second pivot portion 119 is formed in a portion in which the first pivot portion 117 and the display portion 15 are joined to each other, and includes the pivot shaft 35 formed in a direction within a face perpendicular to the axis M. The second pivot portion 119 is configured such that the display portion 15 may be pivoted by substantially 180 degrees across the first pivot portion 117 by pivoting the display portion 15 about the pivot shaft 35.

Here, a second pivot portion 119 is formed of a conductive material. The first pivot portion 117 and the second pivot portion 119 are joined to each other by using bolts 141, nuts 142, and washers 143 that are formed of conductive material. In addition, end portions of the wirings 29 are electrically connected to the washers 143 by soldering or the like. Further, an end portion 119*a* of the second pivot portion 119 on a display portion 15 side is located in a hollow space inside the display portion 15, and one end portion of one of wirings 129 is electrically connected to the end portion 119*a*, while the other end portion (not shown) of the wiring 129 is connected to the electric circuit. With this structure, even when the display portion 15, the first pivot portion 117, and the second pivot portion 119 are caused to pivot in order to allow the display portion 15 to be visually recognized, the wirings 29 and 129 are not twisted, which may improve the durability of the wirings 29 and 129.

According to this embodiment, the second pivot portion 119 may be made to function as a part of the wirings, and hence a wiring length may be shortened. Further, bending deformation of the wirings 29 and 129 are not repeated in the second pivot portion 119, and hence it is possible to improve the durability of the tuning device 110. Further, the wirings are not exposed, and hence it is possible to enhance the appearance.

Figure 8:
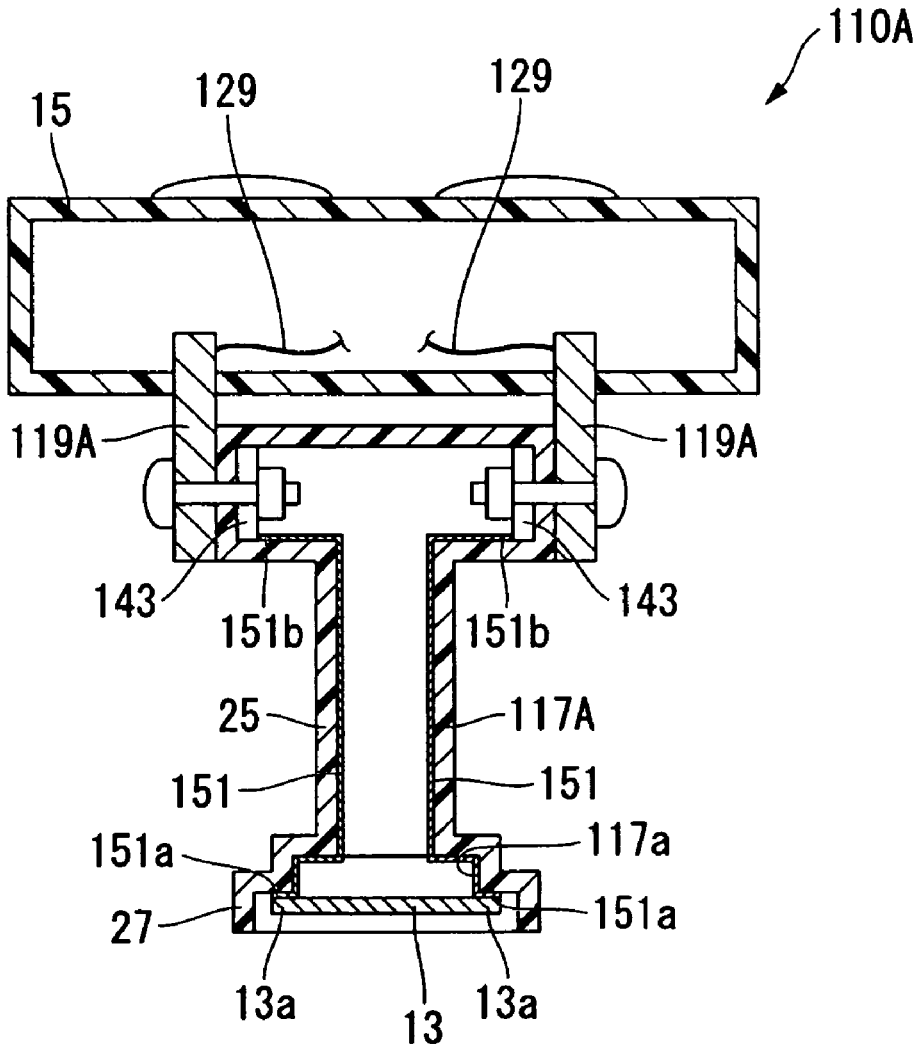
FIG. 8 is a sectional view (from the direction of the arrow B of FIG. 1) illustrating a modified example of the first pivot portion and the second pivot portion according to the second embodiment of the present invention.
Figure 9:
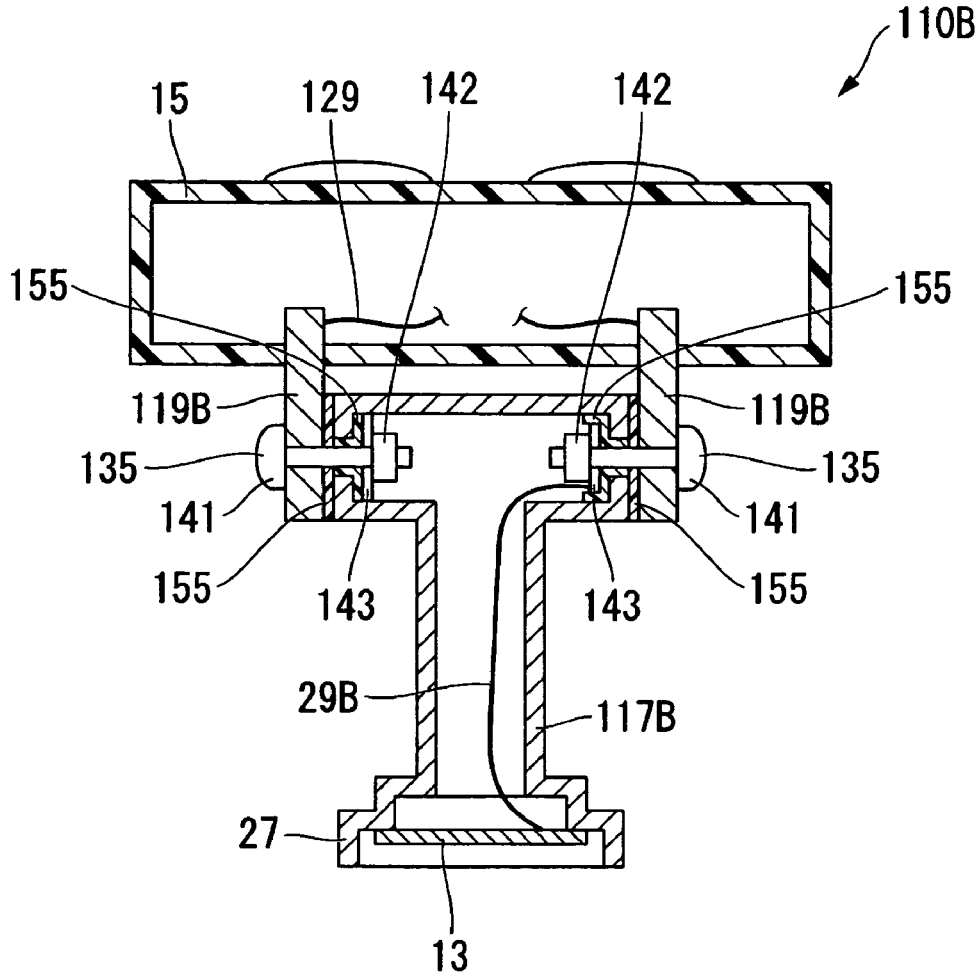
FIG. 9 is a sectional view (from the direction of the arrow B of FIG. 1) illustrating another modified example of the first pivot portion and the second pivot portion according to the second embodiment of the present invention.
Figure 10:
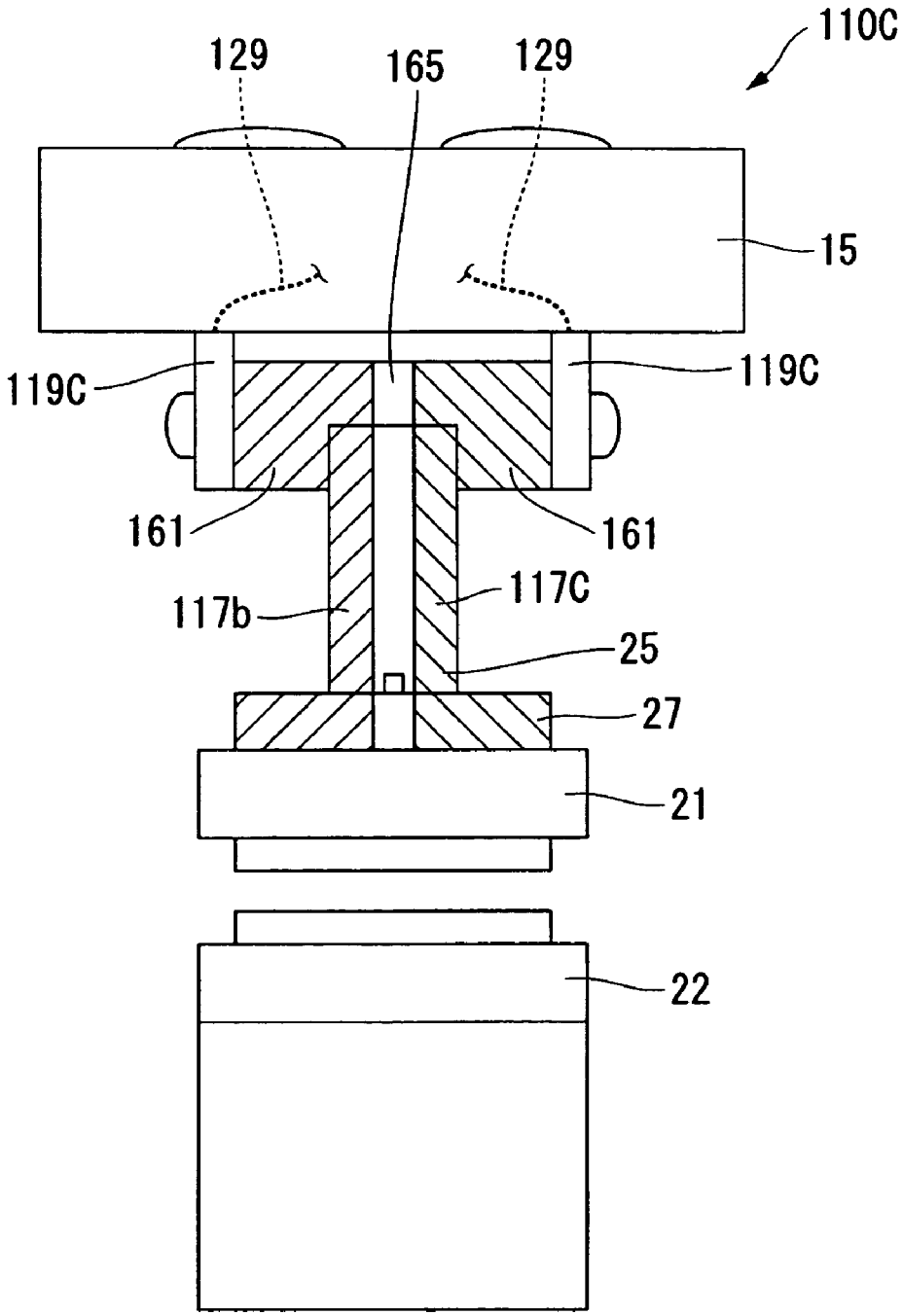
FIG. 10 is a sectional view (from the direction of the arrow B of FIG. 1) illustrating further another modified example of the first pivot portion and the second pivot portion according to the second embodiment of the present invention.

Note that tuning devices as illustrated in FIGS. 8 to 10 may be employed as modified examples of this embodiment.

In FIG. 8, a first pivot portion 117A of a tuning device 110A is a member made of, for example, resin and having a substantially cylindrical shape. The first pivot portion 117A is hollow inside, and contains the vibration sensor 13 in the inside of the containing portion 27. The vibration sensor 13 has the peripheral portion 13*a* adhered/fixed to the inner surface 117*a* of the first pivot portion 117A by an adhesive or the like. In addition, a second pivot portion 119A is formed of a conductive material.

Here, a plating wiring 151 is formed on the inner surface 117*a* of the first pivot portion 117A, and one end portion 151*a* of the plating wiring 151 is electrically connected to the vibration sensor 13, while the other end portion 151*b* of the plating wiring 151 is electrically connected to the washers 143. Such a structure allows the first pivot portion 117A and the second pivot portion 119A to function as parts of the wirings. Accordingly, the wirings 129 are located only in a part in which the second pivot portion 119A and the electric circuit disposed inside the display portion 15 are connected to each other, which makes it possible to reliably suppress the breaking of the wirings 129 and to improve the durability of the tuning device 110A.

In a tuning device 110B illustrated in FIG. 9, a first pivot portion 117B and a second pivot portion 119B are both formed of a conductive material. The containing portion 27 contains the vibration sensor 13 in the inside thereof. In other words, the vibration sensor 13 and the first pivot portion 117B are electrically connected to each other.

Here, this modified example employs the first pivot portion 117B formed of a conductive material as one of the two wirings inside the first pivot portion 117B that connect the vibration sensor 13 and the electric circuit inside the display portion 15 to each other. In other words, the electrical signal from the vibration sensor 13 is transmitted to the second pivot portion 119B via the first pivot portion 117B, one of the washers 143 (washer on the left of FIG. 9), and the bolt 141, and further transmitted to the electric circuit inside the display portion 15 via the wiring 129 connected to the second pivot portion 119B.

Note that a wiring 29B located inside the first pivot portion 117B is provided between the vibration sensor 13 and the other washer 143 (washer on the right of FIG. 9). Further, in order to allow the electrical signal from the vibration sensor 13 to be transmitted to the electric circuit of the display portion 15 without developing a short circuit, an insulating material 155 is provided to a joint portion among one of pivot shafts 135 to which the wiring 29B is connected, the first pivot portion 117B, and the second pivot portion 119B, and a path is secured for the electrical signal from the wiring 29B. Such a structure allows the first pivot portion 117B and the second pivot portion 119B to function as parts of the wirings. Accordingly, the wirings are located only inside the first pivot portion 117B and a part in which the second pivot portion 119B and the electric circuit disposed inside the display portion 15 are connected to each other, which makes it possible to reliably suppress the breaking of the wirings and to improve the durability of the tuning device 110B.

In FIG. 10, a first pivot portion 117C of a tuning device 110C is a member made of resin. The first pivot portion 117C is hollow inside, and contains the vibration sensor 13 in the inside of the containing portion 27. The vibration sensor 13 has the peripheral portion 13*a* adhered/fixed to the inner surface 117*a* of the first pivot portion 117C by an adhesive or the like.

Here, plating wirings (not shown) are formed from the inner surface 117*a* joined to the peripheral portion 13*a* of the vibration sensor 13 across to an external surface 117*b*. In addition, platings 161 are applied to the external surface 117*b* of the first pivot portion 117C, with a non-plating portion 165 set as a boundary, on both sides thereof. In other words, the first pivot portion 117C has a function of serving as two wirings. Each of the platings 161 is electrically connected to a second pivot portion 119C formed of a conductive material. Such a structure allows the first pivot portion 117C and the second pivot portion 119C to function as parts of the wirings. Accordingly, the wirings 129 are located only in a part in which the second pivot portion 119C and the electric circuit disposed inside the display portion 15 are connected to each other, which makes it possible to reliably suppress the breaking of the wirings and to improve the durability of the tuning device 110C.

Note that the present invention is not limited to the above-mentioned embodiments, and includes various modifications of the above-mentioned embodiments within the scope that does not depart from the gist of the invention. That is, the specific configurations, structures, and the like illustrated in the embodiments are mere examples, and may be changed as appropriate.

For example, in this embodiment, the piezoelectric element externally having a substantially circular shape is used as the vibration sensor, but the piezoelectric element externally having a rectangle shape such as a square shape may be used instead.

Further, in this embodiment, the case in which the wirings are placed in internal spaces of the first pivot portion and the second pivot portion has been described, but, for example, the wirings placed inside the first pivot portion may be exposed to an outside from a midway thereof, after which the wirings may be extended directly to the inside of the display portion without passing through the inside of the second pivot portion.

Figure 11:
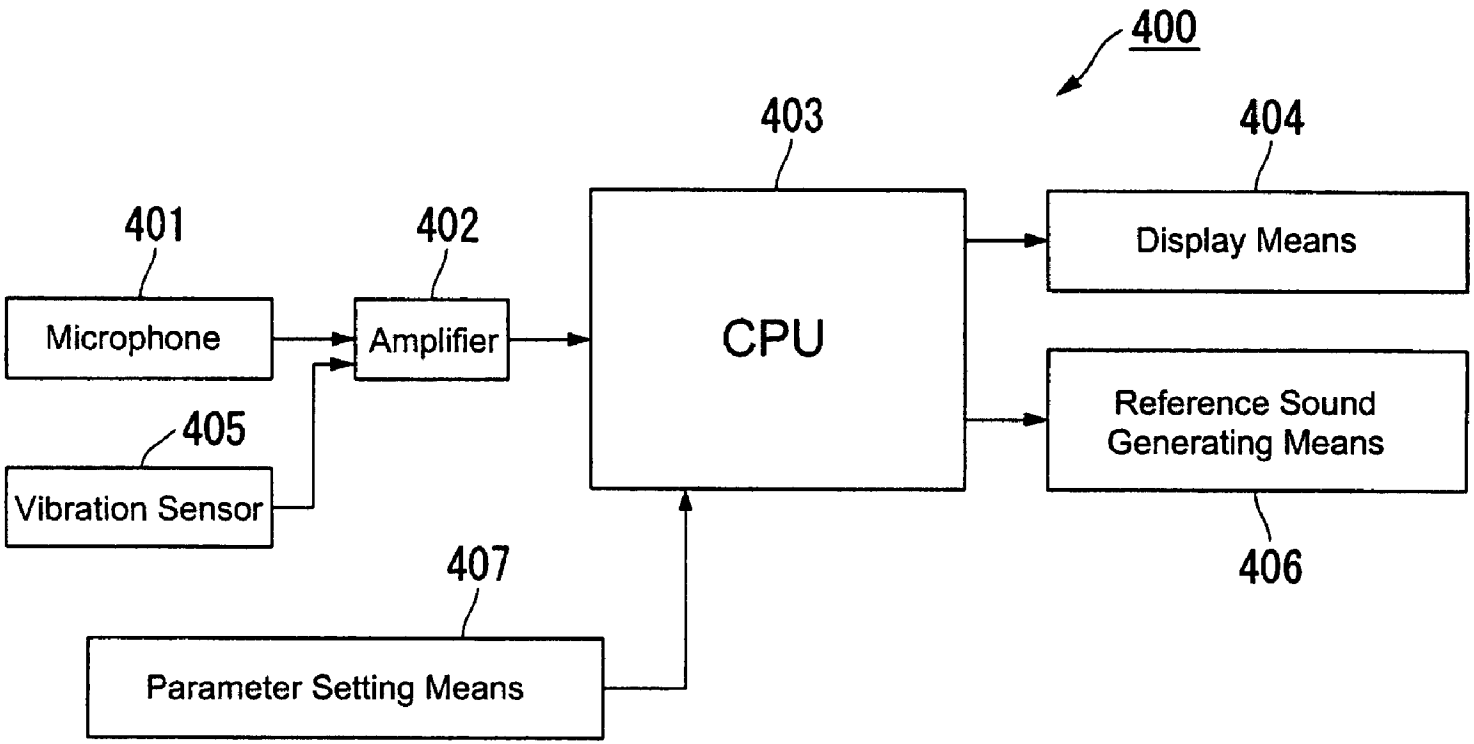
Prior Art Fig. 11
FIG. 11 is a block diagram illustrating a structure of a conventional tuning device.
Figure 12:
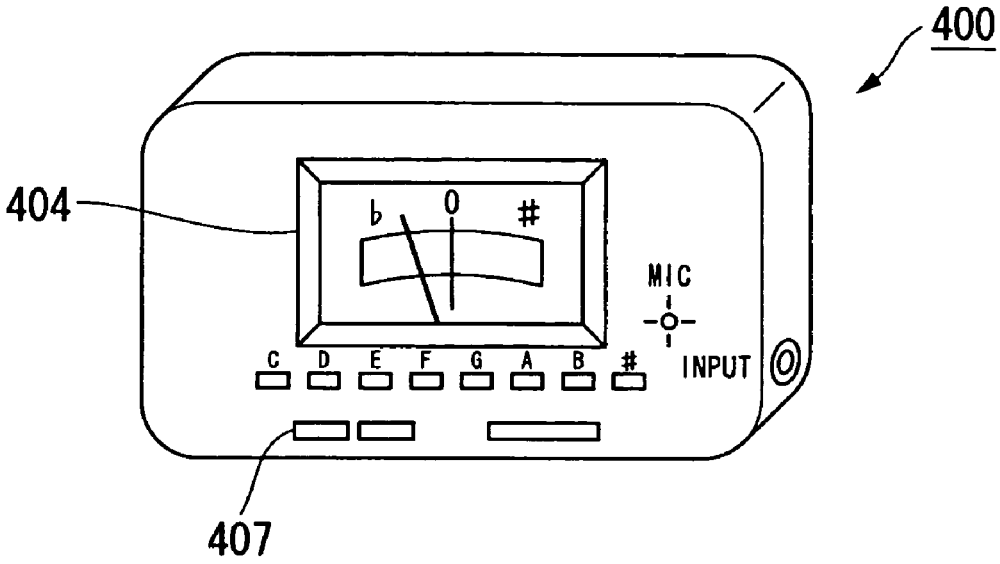
Fig. 12 Prior Art
FIG. 12 is a front view illustrating the conventional tuning device.

Further, as illustrated in FIG. 11, the tuning device 400 may include reference sound generating means 406 so as to have the reference sound generating function of generating a reference sound set by the reference sound setting means of the CPU 403 to thereby notify the user of the pitch of the reference sound to which the musical instrument is to be tuned. In this case, the tuning function and the reference sound generating function may be selected by the user through parameter setting means 407.

What is claimed is:

1. A tuning device, comprising:

a tuning device main body including an electric circuit for computing a tuning state of a musical instrument;

a clip portion including a pair of plate materials for attaching the tuning device main body to the musical instrument;

a joint member for joining the tuning device main body and the clip portion; and a vibration sensor for sensing a sound emitted from the musical instrument, the joint member comprising:

a first pivot portion that mounts the clip portion to pivot about an axis that extends in an extension direction of the joint member; and a second pivot portion that mounts the tuning device main body to pivot about an axis that extends in a direction perpendicular to the extension direction, wherein the vibration sensor is incorporated into the joint member so as to be rotatable about the axis that extends in the extension direction unitarily along with the tuning device main body.

2. A tuning device according to claim 1, wherein:

the joint member is disposed to penetrate one of the plate materials of the clip portion; and the vibration sensor is located on an abutment surface side of the one of the plate materials in abutment with the musical instrument.

3. A tuning device according to claim 2, wherein the vibration sensor and the electric circuit disposed inside the tuning device main body are connected to each other by wirings that are suspended inside the joint member.

4. A tuning device according to claim 2, wherein:

the second pivot portion includes a pivot shaft formed of a conductive material; and the vibration sensor and the electric circuit disposed inside the tuning device main body are electrically connected to each other via the pivot shaft.

5. A tuning device according to claim 4, wherein:

the joint member includes plating wirings on one of an inner surface thereof and an outer surface thereof; and the vibration sensor and the electric circuit are electrically connected to each other via the plating wirings.

6. A tuning device according to claim 4, wherein:

the joint member is formed of a conductive material; and the vibration sensor and the electric circuit are electrically connected to each other via the joint member.

7. A tuning device according to claim 1, wherein the vibration sensor and the electric circuit disposed inside the tuning device main body are connected to each other by wirings that are suspended inside the joint member.

8. A tuning device according to claim 1, wherein:

the second pivot portion includes a pivot shaft formed of a conductive material; and the vibration sensor and the electric circuit disposed inside the tuning device main body are electrically connected to each other via the pivot shaft.

9. A tuning device according to claim 8, wherein:

the joint member includes plating wirings on one of an inner surface thereof and an outer surface thereof; and the vibration sensor and the electric circuit are electrically connected to each other via the plating wirings.

10. A tuning device according to claim 8, wherein:

the joint member is formed of a conductive material; and the vibration sensor and the electric circuit are electrically connected to each other via the joint member.

* * * * *